US008567585B2

(12) United States Patent
Okamura et al.

(10) Patent No.: US 8,567,585 B2
(45) Date of Patent: Oct. 29, 2013

(54) MONEY HANDLING APPARATUS

(75) Inventors: Masao Okamura, Tatsuno (JP); Kazuhiro Doi, Himeji (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 13/388,562

(22) PCT Filed: Aug. 3, 2009

(86) PCT No.: PCT/JP2009/063749
§ 371 (c)(1),
(2), (4) Date: Feb. 2, 2012

(87) PCT Pub. No.: WO2011/016104
PCT Pub. Date: Feb. 10, 2011

(65) Prior Publication Data

US 2012/0125734 A1 May 24, 2012

(51) Int. Cl.
*G07D 7/00* (2006.01)

(52) U.S. Cl.
USPC ..... 194/216

(58) Field of Classification Search
USPC ..... 194/205, 206, 215, 216; 209/534; 235/379; 700/215, 224, 225, 226; 902/8–15
See application file for complete search history.

(56) References Cited

U.S. PATENT DOCUMENTS 4,905,839 A * 3/1990 Yuge et al. ..... 209/534
4,980,543 A * 12/1990 Hara et al. ..... 235/379
2003/0015395 A1 1/2003 Hallowell et al.

FOREIGN PATENT DOCUMENTS

JP 2-93782 4/1990
JP 6-76156 9/1994
WO WO 03/083788 A1 10/2003

OTHER PUBLICATIONS

European Search Report (Application No. 09848037.9—PCT/JP2009/063749) (6 pages—dated Apr. 8, 2013).

* cited by examiner

*Primary Examiner* — Mark Beauchaine
(74) *Attorney, Agent, or Firm* — Renner, Kenner, Greive, Bobak, Taylor & Weber

(57) ABSTRACT

A money handling apparatus (10, 60) includes a collecting and storing unit (20, 71, 72) provided in a housing (10*a*, 60*a*), the collecting and storing unit (20, 71, 72) being configured to store money transported by a transport unit (15, 65). A memory unit (37, 87) is configured to store an amount-of-money data which is a money amount of money stored in the collecting and storing unit (20, 71, 72), and a limit sum which is a money amount of money that can be stored in the collecting and storing unit (20, 71, 72). Based on the amount-of-money data and the limit sum respectively stored in the memory unit (37, 87), the control unit (30, 80) performs a control such that the amount-of-money data does not exceed the limit sum, when there is performed a money collecting process in which money in the collecting and storing unit (20, 71, 72) is taken out from the housing (10*a*, 60*a*) of the money handling apparatus (10, 60).

15 Claims, 9 Drawing Sheets

MONEY HANDLING APPARATUS

CROSS-REFERENCE TO RELATED APPLICATION

This application is the National Stage of International Application No. PCT/JP2009/063749, filed on Aug. 3, 2009.

FIELD OF THE INVENTION

The present invention relates to a money handling apparatus in which money such as banknotes and coins, which have been taken into an inside of a housing, are stored in a collecting and storing unit, and a money collecting process for collecting the money in the collecting and storing unit is performed.

BACKGROUND ART

Various types of money handling apparatuses have been known as a money handling apparatus in which money such as banknotes and coins are taken into an inside of a housing, and the money taken into the inside of the housing are stored in a collecting and storing unit. In such a money handling apparatus, the collecting and storing unit can be attached to and detached from the housing, and a money collecting process for collecting the money in the collecting and storing unit is performed by detaching the collecting and storing unit from the housing. Apparatuses disclosed in Patent Document 1, Patent Document 2 and so on are known as this type of money handling apparatus.

In a deposit and dispense apparatus for shop shown in Patent Document 1, deposited money is stored as shop funds in a recycle storing unit. By a delivery process by which money is transported from the recycle storing unit storing the shop funds to a cassette storing unit storing shop sales proceeds, the money as shop funds are changed to money as the shop sales proceeds, and are managed as such. In the above deposit and dispense apparatus for shop, when the money delivery process is performed, an amount of money to be left in the recycle storing unit as shop funds can be set. In addition, the cassette storing unit storing money can be replaced with an empty cassette and collected by a collecting agency such as an armoured car company.

In a sales proceeds deposit machine shown in Patent Document 2, money of different denominations are recognized and counted, the money is escrowed in a mixed state, and the escrowed money is collectively stored or returned. According to such a sales proceeds deposit machine, the escrowed money can be rapidly stored or returned. It is noted that a cash collection and delivery agency has the management authority of the storing unit and when money is stored in the storing unit, it means that the money is delivered to the cash collection and delivery agency. In the above sales proceeds deposit machine, the storing cassette storing money can be replaced with an empty cassette and collected by a collecting agency such as an armoured car company.

Patent Document 1: JP2003-141609A
Patent Document 2: JP2001-67526A

DISCLOSURE OF THE INVENTION

In the apparatuses shown in Patent Document 1 and Patent Document 2, whether an amount of money stored in a collecting cassette exceeds a capacity of the collecting cassette or not is judged by confirming the number of money stored therein or a volume thereof. This method is effective when it is desired money is collected as many as possible.

However, in a case of a cassette capable of storing, e.g., 1000 banknotes or more, when banknotes of a largest denomination are stored in the cassette until the cassette becomes full, the money amount of the banknotes stored in the cassette is significantly large. In this case, there is a demand for dispersing money for safety. In addition, when a collecting cassette is transported by an armoured car company or the like, there is a case in which the collecting cassette is insured. In this case, depending on insurance companies, a limitation may be imposed on a money amount of money stored in the cassette. To be specific, an insurance is invalid for money exceeding the limit sum, for example.

Namely, in the conventional apparatus, it sometimes happens that a money amount of money stored in the collecting cassette comes into problem. However, in the conventional apparatuses shown in Patent Document 1 and Patent Document 2, since the number of money to be stored in the collecting cassette is determined based on a volume of the collecting cassette, it is impossible to cope with the problem relating to the money amount of stored money. Although it is possible to check a money amount of the money stored in the collecting cassette, and to deposit money while specifying a difference between the money amount and a limit sum, it is impossible to absolutely prevent an operation mistake and/or a calculation mistake by an operator. Such a problem is not limited to the case in which the collecting cassette is used as the collecting and storing unit. When another container such as a pouch is used as the collecting and storing unit, or when the collecting and storing unit is opened so as to directly take out money, such a problem arises.

The present invention has been made in view of the above circumstances. The object of the present invention is to provide a money handling apparatus in which a money collecting process can be performed in a state where an amount-of-money data of money stored in a collecting and storing unit is certainly not more than a limit sum thereof, so that a money amount of money to be stored in the collecting and storing unit can be controlled.

A money handling apparatus of the present invention is a money handling apparatus which includes: a feeding unit configured to feed out money one by one; a transport unit connected to the feeding unit, the transport unit being configured to transport money; a recognition unit provided on the transport unit, the recognition unit being configured to recognize at least a denomination of the money transported by the transport unit; a collecting and storing unit provided in a housing of the money handling apparatus, the collecting and storing unit being configured to store the money transported by the transport unit; a memory unit configured to store an amount-of-money data which is a money amount of money stored in the collecting and storing unit, and a limit sum which is a money amount of money that can be stored in the collecting and storing unit; and a control unit configured to perform a control such that, the amount-of-money data does not exceed the limit sum, based on the amount-of-money data and the limit sum respectively stored in the memory unit, when there is performed a money collecting process in which money in the collecting and storing unit is taken out from the housing of the money handling apparatus.

According to such a money handling apparatus, a money collecting process can be performed in a state where the amount-of-money data of the money stored in the collecting and storing unit is certainly not more than the limit sum thereof, so that a money amount of money to be stored in the collecting and storing unit can be controlled.

In the money handling apparatus of the present invention, the control unit may be configured to control the process such that, when a total sum of a money amount of the money, which is to be sent to the collecting and storing unit and is recognized by the recognition unit, and the amount-of-money data becomes larger than the limit sum, the transport of the money from the transport unit to the collecting and storing unit is stopped.

Thus, after the money in the collecting and storing unit have been collected, the collecting process can be continuously performed.

In this case, when the transport of the money to the collecting and storing unit becomes possible after the money collecting process has been performed, the control unit may perform a control such that the transport of the money to the collecting and storing unit is resumed.

Thus, the collecting process can be efficiently performed.

In the money handling apparatus of the present invention, the control unit may be configured to control the process such that, when a total sum of a money amount of the money, which is to be sent to the collecting and storing unit and is recognized by the recognition unit, and the amount-of-money data becomes larger than the limit sum, the destination of the money recognized by the recognition unit is changed from the collecting and storing unit to another processing unit.

Thus, the collecting process can be finished, and another process can be performed.

Alternatively, in the money handling apparatus of the present invention, the collecting and storing unit may feed money stored in the collecting and storing unit to the transport unit, and the control unit may be configured to perform a control such that, before the money collecting process is performed, when the amount-of-money data is larger than the limit sum, money stored in the collecting and storing unit is fed out to the transport unit and the fed-out money is transported to another processing unit, so that the amount-of-money data becomes not more than the limit sum.

Thus, excluding when the money collecting process is performed, the collecting and storing unit can store money whose money amount is not less than the limit sum. As a result, the storing space can be efficiently utilized In the aforementioned money handling apparatus, the other processing unit may be a dispense unit configured to take out money to an outside of the housing of the money handling apparatus.

Alternatively, a plurality of the collecting and storing units may be provided, and when money transported by the transport unit is stored into one of the plurality of collecting and storing units, the control unit may make another collecting and storing unit serve as the other processing unit.

Alternatively, the other processing unit may be a storing and feeding unit provided in the housing of the money handling apparatus, the storing and feeding unit being configured to store and feed money.

Thus, the money can be used as money to be dispensed, or the collecting process can be resumed.

In the aforementioned money handling apparatus, when the transport of money to the collecting and storing unit becomes possible after the money collecting process has been performed, the control unit may perform a control such that money is fed out from the storing and feeding unit, and the transport of the money to the collecting and storing unit is resumed.

Thus, the collecting process can be efficiently performed.

In the money handling apparatus of the present invention, the money handling apparatus may further include a display unit configured to display a difference between the amount-of-money data and the limit sum.

Thus, since the difference can be confirmed, it is possible to previously confirm whether money to be stored in the collecting and storing unit can be stored therein or not.

In the money handling apparatus of the present invention, after the money collecting process has been performed and before the transport of money to the collecting and storing unit becomes possible, there may be performed a confirmation as to whether there remains money in the collecting and storing unit or not, or as to an amount-of-money data thereof.

Thus, it is possible to guarantee that the money amount of money in the collecting and storing unit does not exceeds the limit sum thereof.

According to the money handling apparatus of the present invention, by controlling the money amount of money to be stored in the collecting and storing unit, the money collecting process can be performed in a state where the amount-of-money data of money stored in the collecting and storing unit is certainly not more than the limit sum thereof.

DETAILED DESCRIPTION OF THE INVENTION

First Embodiment

A banknote handling apparatus in a first embodiment of the present invention is described herebelow with reference to the drawings. FIGS. 1 to 6 are views showing the banknote handling apparatus in the first embodiment of the present invention.

Figure 1:
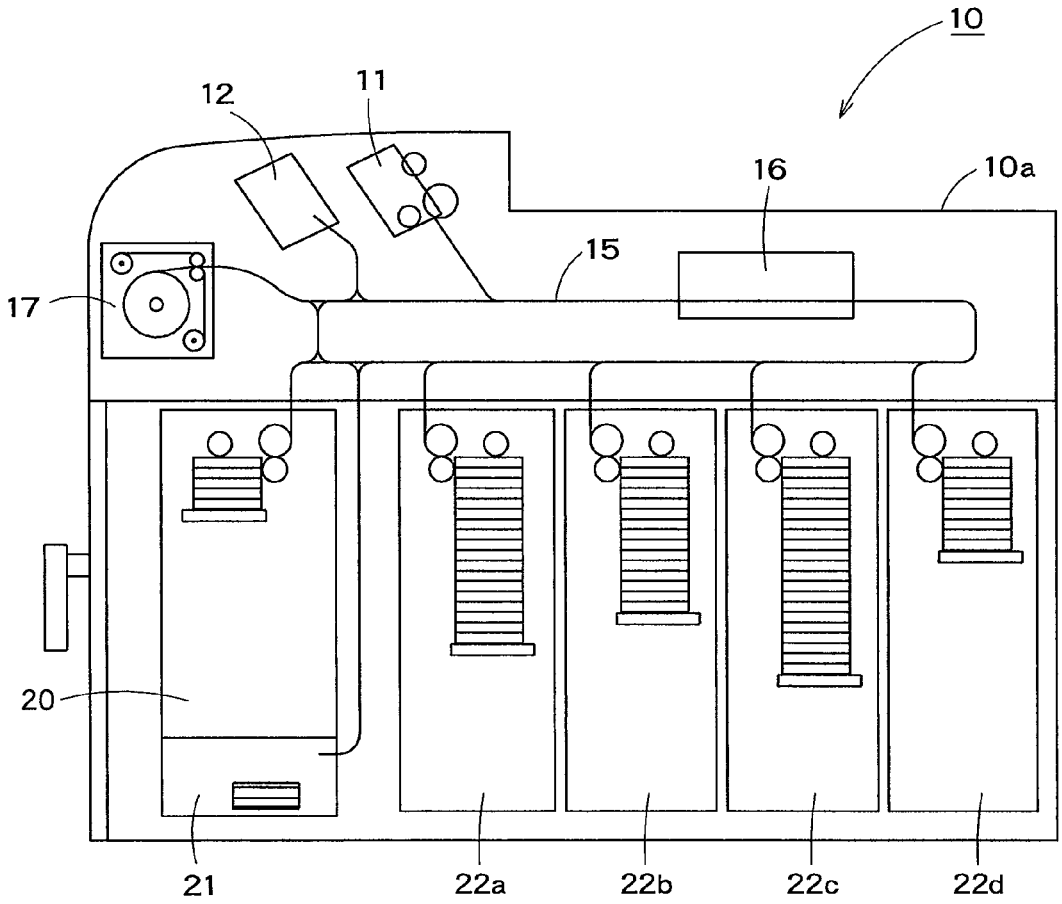
FIG. 1 is a structural view schematically showing a structure of a banknote handling apparatus in a first embodiment of the present invention.

As shown in FIG. 1, the banknote handling apparatus 10 includes a housing 10*a* of a substantially rectangular parallelepiped shape, a deposit unit 11 for taking a banknote into an inside of the housing 10*a* from an outside thereof, and a dispense unit 12 for taking out a banknote from the inside of the housing 10*a* to the outside thereof. In addition, a transport unit 15 for transporting a banknote is provided in the inside of the housing 10*a*. Diversion means, not shown, are disposed on diverted positions of the transport unit 15, whereby a destination of a banknote can be controlled. A banknote, which has been taken into the inside of the housing 10*a* by the deposit unit 11 is transported by the transport unit 15. The deposit unit 11 has a feeding mechanism (not shown) for feeding out banknotes, one by one, which are stacked in the deposit unit 11, to the transport unit 15. Banknotes, which have been transported from the transport unit 15 to the dispense unit 12, are stacked in the dispense unit 12. The dispense unit 12 is provided with a shutter that opens and closes the dispense unit 12. By opening the shutter, it is possible to access the dispense unit 12 from outside, and a banknote can be taken out from the dispense unit 12.

The transport unit 15 is provided with a recognition unit 16 that recognizes a denomination, an authenticity, a fitness and so on of a banknote that is transported by the transport unit 15. A recognition result of a banknote recognized by the recognition unit 16 is sent to a control unit 30 which will be described below. Inside the housing 10*a*, an escrow unit 17 is connected to the transport unit 15. A banknote, which has been taken by the deposit unit 11 into the inside of the housing 10*a* and recognized by the recognition unit 16, is optionally sent to the escrow unit 17, and is escrowed in the escrow unit 17. The escrow unit 17 can feed banknotes, one by one, which are escrowed in the escrow unit 17, to the transport unit 15. The escrow unit 17 is formed of a unit of a tape reeling type, in which banknotes separated apart from each other are sandwiched between a pair of elongate tapes. By reeling up the banknotes together with the pair of tapes around a roller, the plurality of banknotes can be escrowed in the escrow unit 17.

In addition, inside the housing 10*a*, a collecting and storing cassette 20 is connected to the transport unit 15. The collecting and storing cassette 20 is detachably attached to the inside of the housing 10*a*, and is configured to store banknotes sent from the transport unit 15 in a stacked manner. When a collecting agency takes out the collecting and storing cassette 20 from the housing 10*a* so as to collect the collecting and storing cassette 20 itself, a banknote collecting process for collecting banknotes stored in the collecting and storing cassette 20 can be performed. In addition, the collecting and storing cassette 20 can feed banknotes, one by one, which are stored in the collecting and storing cassette 20, to the transport unit 15, and can replenish the banknote handling apparatus 10 with banknotes.

In addition, inside the housing 10*a*, a reject storing unit 21 of the collecting and storing cassette 20 is connected to the transport unit 15. A rejected banknote is sent to the reject storing unit 21 from the transport unit 15, and the rejected banknote is stored therein. Since the reject storing unit 21 is integral with the collecting and storing cassette 20, the rejected banknote can be collected by collecting the collecting and storing cassette 20.

In addition, inside the hosing 10*a*, a plurality of (e.g., four) stackers 22*a* to 22*d* are connected to the transport unit 15. Banknotes are sent to the respective stackers 22*a* to 22*d* according to their denominations, and the respective stackers 22*a* to 22*d* are configured to store the banknotes in a stacked manner according to their denominations. In addition, the respective stackers 22*a* to 22*d* can feed banknotes, one by one, which are stored therein, to the transport unit 15.

Next, the control unit 30 configured to control the respective constituent elements in the banknote handling apparatus 10 is described with reference to FIG. 2. The control unit 30 is located inside the housing 10*a* of the banknote handling apparatus 10.

Figure 2:
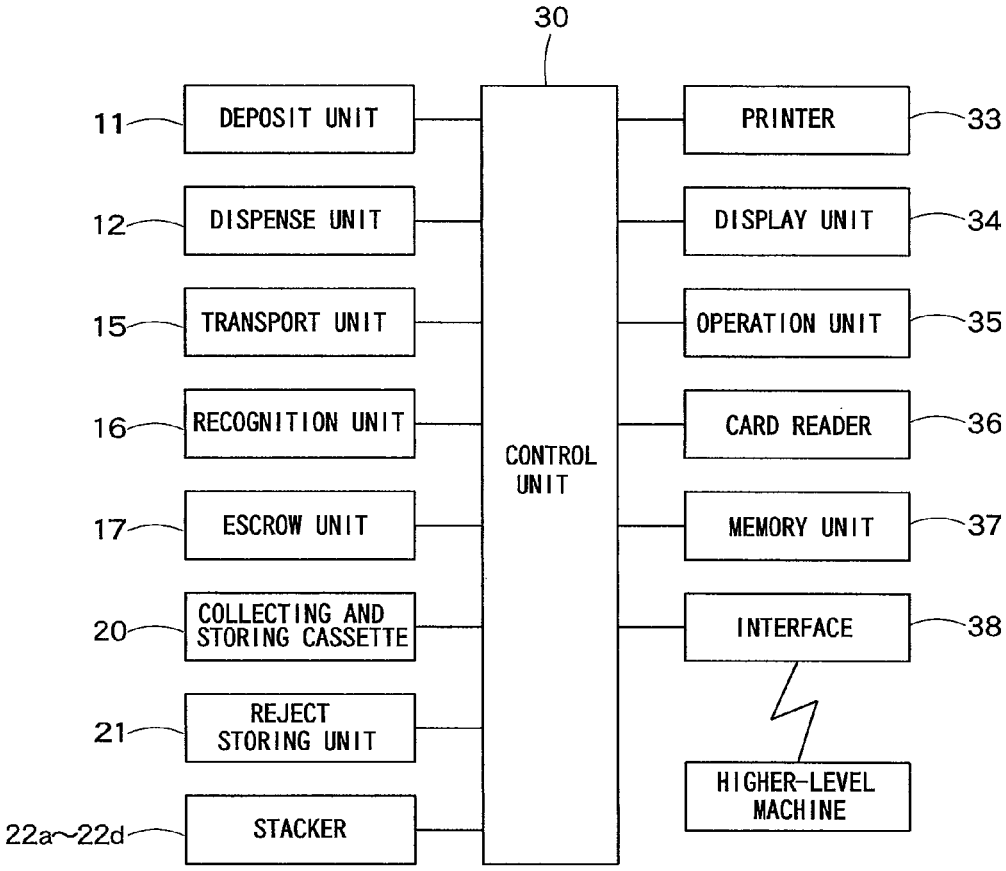
FIG. 2 is a control block diagram of the banknote handling apparatus shown in FIG. 1.

As shown in FIG. 2, connected to the control unit 30 are the respective constituent elements of the banknote handling apparatus 10 (e.g., the deposit unit 11, the dispense unit 12, the transport unit 15, the recognition unit 16, the escrow unit 17, the collecting and storing cassette 20, the reject storing unit 21, the stackers 22*a* to 22*d* and so on), a printer 33, a display unit 34, an operation unit 35, a card reader 36, a memory unit 37, an interface 38 and so on.

Information such as a banknote recognition result by the recognition unit 16 is sent to the control unit 30. Further, an ID of an ID card of an operator and an ID of the collecting and storing cassette 20, which are read by the card reader 36, are sent to the control unit 30. Furthermore, a command of an operator is sent to the control unit 30 through the operation unit 35.

In addition, the control unit 30 is configured to control the respective constituent elements of the banknote handling apparatus 10, and to control the printer 33, the display unit 34 and so on. Further, the control unit 30 can communicate with a higher-level machine such as a host computer, through the interface 38 connected to the control unit 30. The memory unit 37 is connected to the control unit 30, whereby a banknote recognition result and various information can be stored. In the banknote handling apparatus 10 in this embodiment, the memory unit 37 is configured to store an amount-of-money data of a banknote actually stored in the collecting and storing cassette 20, and a limit sum which is a money amount of banknotes that can be stored in the collecting and storing cassette 20. The limit sum stored in the memory unit 37 can be set as a given money amount, by an operator through the operation unit 35. However, an upper limit of the limit sum is a value obtained by multiplying the number of banknotes which can be stored in the collecting and storing cassette 20 and a largest denomination of a banknote. In addition, the memory unit 37 is configured to store the number of banknotes which can be stored in the collecting and storing cassette 20 (the number of banknotes with which the collecting and storing cassette 20 becomes full).

Next, an operation of the banknote handling apparatus 10 as structured above is described.

At first, a banknote deposit process and a banknote dispense process performed by the banknote handling apparatus 10 are briefly described.

In the banknote deposit process performed by the banknote handing apparatus 10, banknotes, which have been fed one by one to the inside of the housing 10*a* from the deposit unit 11, are transported to the recognition unit 16, and the recognition unit 16 recognizes a denomination and an authenticity and so on of the banknotes. A banknote which is recognized as a normal banknote is stored in the respective stackers 22*a* to 22*d*. On the other hand, a banknote which is recognized as an unacceptable banknote is returned to the dispense unit 12. Before the banknote is stored in the respective stackers 22*a* to 22*d*, the banknote may be stored in the escrow unit 17, and the banknote may be then stored in the respective stackers 22*a* to 22*d*, after a "confirmation" has been inputted through the operation unit 35.

In a banknote dispense process performed by the banknote handling apparatus 10, when a denomination or a denomination and the number of banknotes to be dispensed is/are inputted through the operation unit 35, the control unit 30 controls such that banknotes are fed from the respective stackers 22*a* to 22*d* to the dispense unit 12, and the banknotes are stacked in the dispense unit 12.

In the banknote handling apparatus 10 in this embodiment, as described above, an amount-of-money data of banknotes stored in the collecting and storing cassette 20, and a limit sum which is a money amount of banknotes that can be stored in the collecting and storing cassette 20, are respectively stored in the memory unit 37. When a banknote collecting process is performed, the control unit 30 controls the transport unit 15 such that the amount-of-money data of the collecting and storing unit 20 does not exceed the limit sum. Herein, the banknote collecting process means a process in which a collecting agency takes out the collecting and storing cassette 20 storing banknotes from the housing 10*a* so as to collect the taken-out collecting and storing cassette 20 itself, and thereafter the collecting agency returns the empty collecting and storing cassette 20 to the housing 10*a*. In the collecting process, the collecting and storing unit is not limited to a cassette type unit. Instead of using the collecting and storing cassette 20, a pouch-type collecting and storing unit may be replaced, or banknotes may be directly taken out from a collecting and storing unit fixed on the housing 10*a*. Namely, the banknote collecting process is a process by which a banknote is taken out from the housing 10*a*.

<First Mode of Operation of Banknote Handling Apparatus 10 in First Embodiment>

As a first mode of an operation of the banknote handling apparatus 10, the control unit 30 is configured to control the process such that, when a total sum of a money amount of a banknote, which is to be sent to the collecting and storing cassette 20 and is recognized by the recognition unit 16, and an amount-of-money data of banknotes in the collecting and storing cassette 20 exceeds the limit sum of the collecting and storing cassette 20, the transport of the banknote from the transport unit 15 to the collecting and storing cassette 20 is stopped. Such a first mode of an operation of the banknote handling apparatus 10 is described with reference to the flowchart shown in FIG. 3.

When an operator inputs a start of a deposit collecting process through the operation unit 35, there is performed a deposit collecting process in which a banknote is taken into the inside of the housing 10*a* by the deposit unit 11, and the taken-in banknote is stored in the collecting and storing cassette 20. At this time, there is a case in which the banknote taken into the inside of the housing 10*a* by the deposit unit 11 is escrowed in the escrow unit 17. On the other hand, when an operator inputs a start of a stacker collecting process through the operation unit 35, there is performed a process in which banknotes stored in the respective stackers 22*a* to 22*d* are stored in the collecting and storing cassette 20. The stacker collecting process includes a case in which banknotes are collected while designating the stacker, a denomination or a money amount, a case in which banknotes in all the stackers are collected, or a case in which banknotes are collected such that a predetermined money amount, a predetermined denomination and the predetermined number of banknotes are left. A storing process for storing a banknote into the collecting and storing cassette 20 in the above deposit collecting process and the stacker collecting process is described in detail with reference to the flowchart shown in FIG. 3.

Figure 3:
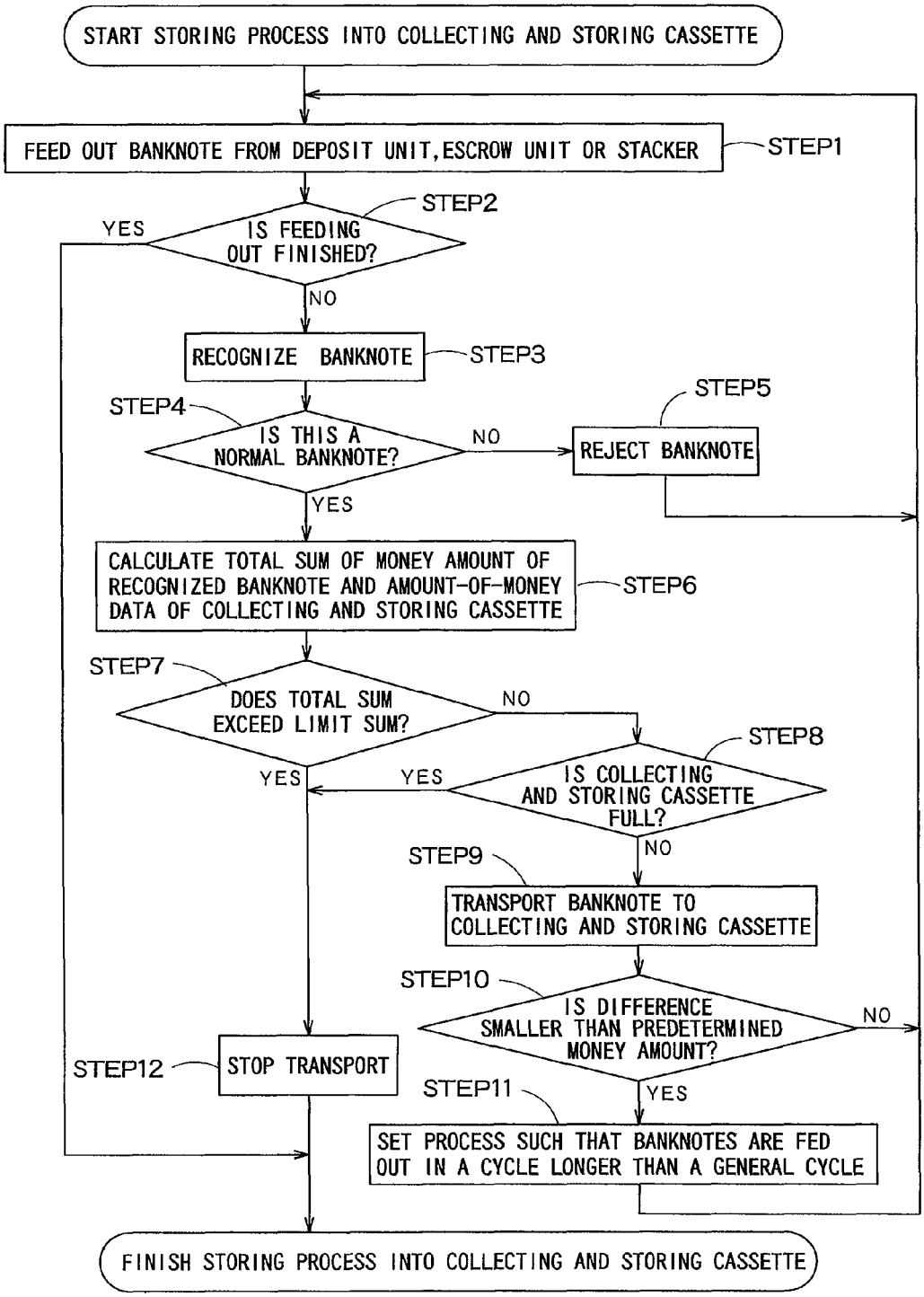
FIG. 3 is a flowchart showing a first mode of an operation of the banknote handling apparatus in the first embodiment of the present invention.

When the storing process for storing a banknote into the collecting and storing cassette 20 is started, banknotes are fed out, one by one, from the deposit unit 11, the escrow unit 17 or the respective stackers 22*a* to 22*d* (STEP 1 of FIG. 3). In the flowchart shown in FIG. 3, a process for one banknote is shown. However, in general, a subsequent banknote is continuously fed out after the first banknote has been fed out. Namely, the next banknote is fed out, without waiting the completion of the series of processes shown in the flowchart of FIG. 3.

After the feeding of a banknote from the deposit unit 11, the escrow unit 17 or the respective stackers 22*a* to 22*d* has been finished ("YES" in STEP 2 of FIG. 3), the storing process for storing the banknote into the collecting and storing cassette 20 is finished. On the other hand, when the feeding of a banknote from the deposit unit 11, the escrow unit 11 or the respective stackers 22*a* to 22*d* is not finished ("NO" in STEP 2 of FIG. 3), a denomination, an authenticity and so on of the banknote is recognized by the recognition unit 16 (STEP 3 of FIG. 3).

When the banknote recognized by the recognition unit 16 is not a normal banknote ("NO" in STEP 4 of FIG. 3), a reject process for rejecting the banknote is performed (STEP 5 in FIG. 3). Specifically, in a case of the deposit collecting process, such a banknote is sent to the dispense unit 12, and the rejected banknote dispensed to the dispense unit 12 is finally taken by an operator to the outside of the housing 10*a*. In a case of the stacker collecting process, such a banknote is stored in the escrow unit 17. After the feeding operation, the banknote is returned to the respective stackers 22*a* to 22*d*, and is again fed out depending on a process type. On the other hand, when the banknote recognized by the recognition unit 16 is a normal banknote ("YES" in STEP 4 of FIG. 3), the control unit 30 calculates a total sum of a money amount of the recognized banknote and an amount-of-money data of the collecting and storing cassette 20 (STEP 6 in FIG. 3). Included in the amount-of-money data of the collecting and storing cassette 20 is a money amount of a banknote which is to be stored in the collecting and storing cassette 20, and is being transported by the transport unit 15 after having been recognized by the recognition unit 16. When the total sum of the money amount of the banknote recognized by the recognition unit 16 and the amount-of-money data of the collecting and storing cassette 20 exceeds the limit sum thereof ("YES" in STEP 7 of FIG. 3), the transport of the banknote is stopped (STEP 12 of FIG. 3), and the storing process for storing a banknote into the collecting and storing cassette 20 is finished.

On the other hand, when the total sum of the money amount of the banknote recognized by the recognition unit 16 and the amount-of-money data of the collecting and storing cassette 20 is not more than the limit sum thereof ("NO" in STEP 7 of FIG. 3), whether the collecting and storing cassette 20 is full or not is detected (STEP 8 of FIG. 3). When the collecting and storing cassette 20 is full ("YES" in STEP 8 of FIG. 3), the transport of the banknote is stopped (STEP 12 of FIG. 3), and the storing process for storing a banknote into the collecting and storing cassette 20 is finished. On the other hand, when the collecting and storing cassette 20 is not full ("NO" in STEP 8 of FIG. 3), the banknote is transported to the collecting and storing cassette 20 (STEP 9 of FIG. 3). At this time, when a difference between the amount-of-money data of the collecting and storing cassette 20 and the limit sum thereof is smaller than a predetermined money amount ("YES" in STEP 10 of FIG. 3), the control unit 30 controls the process such that banknotes are fed out in a cycle longer than a general cycle. Namely, when a difference between the amount-of-money data of the collecting and storing cassette 20 and the limit sum thereof becomes small, an interval between a timing at which one banknote is fed out and a timing at which a subsequent banknote is fed out is increased. Alternatively, a subsequent banknote may be fed out, after the series of processes shown in the flowchart of FIG. 3 have been finished for one banknote.

Instead of the processes shown in the STEPs 6 and 7 in the flowchart of FIG. 3, the following process is possible. Namely, the control unit 30 previously calculates a difference between the limit sum of the collecting and storing cassette 20 and the amount-of-money data thereof, and whether the money amount of the banknote recognized by the recognition unit 16 is not more than the difference or not. That is to say, in this case, when the money amount of the banknote recognized by the recognition unit 16 exceeds the difference between the limit sum of the collecting and storing cassette 20 and the amount-of-money data thereof, the transport of the banknote is stopped (STEP 12 of FIG. 3), and the storing process for storing a banknote into the collecting and storing cassette 20 is finished.

When the transport of the banknote from the transport unit 15 to the collecting and storing cassette 20 is stopped (STEP 12 of FIG. 3), this operation is displayed on the display unit 34. The display unit 34 makes a display for promoting a replacement of the collecting and storing cassette 20. Then, the collecting and storing cassette 20 is taken out from the housing 10*a* by a collecting agency, and the collection of the collecting and storing cassette 20 itself is performed by the collecting agency. Thereafter, the empty collecting and storing cassette 20 is returned to the housing 10*a*. After the empty collecting and storing cassette 20 has been returned to the housing 10*a*, storing of a banknote into the collecting and storing cassette 20 is resumed.

In a case where there is performed the deposit process in which banknotes deposited into the inside of the housing 10*a* by the deposit unit 11 are stored in the respective stackers 22*a* to 22*d*, when each of the stackers 22*a* to 22*d* becomes full, a banknote deposited into the inside of the housing 10*a* is transported to the collecting and storing cassette 20, and is stored in the collecting and storing cassette 20. The storing process for storing a banknote into the collecting and storing cassette 20 in this case is the same as the process shown in the STEP 1 to STEP 12 of the flowchart of FIG. 3.

After the feeding of a banknote from the deposit unit 11, the escrow unit 17 or the respective stackers 22*a* to 22*d* has been finished and the fed-out banknote has been transported to the collecting and storing cassette 20, the collecting and storing cassette 20 is optionally taken out by a collecting agency from the housing 10*a*, and the collection of the collecting and storing cassette 20 itself is performed by the collecting agency. Then, the empty collecting and storing cassette 20 is returned to the housing 10*a*.

As described above, in the first mode of the operation of the banknote handling apparatus 10 in the first embodiment, as shown in the flowchart of FIG. 3, the control unit 30 is configured to control the process such that, when a total sum of a money amount of the banknote, which is to be sent to the collecting and storing cassette 20 and is recognized by the recognition unit 16, and an amount-of-money data of banknotes in the collecting and storing cassette 20 exceeds the limit sum of the collecting and storing cassette 20, the transport of the banknote from the transport unit 15 to the collecting and storing cassette 20 is stopped.

In the aforementioned first mode of the operation of the banknote handling apparatus 10, as shown in FIG. 1, when the escrow unit 17 is formed of a unit of a tape reeling type, in which banknotes separated apart from each other are sandwiched between a pair of elongate tapes, and by reeling up the banknotes together with the pair of tapes around a roller, so that the plurality of banknotes can be escrowed in the escrow unit 17, the following process is possible. Namely, denominations of banknotes recognized by the recognition unit 16 and a storing order of the banknotes into the escrow unit 17 are stored. Then, which banknote out of the banknotes stored in the escrow unit 17 reaches the limit sum is previously obtained by calculation, and the calculated banknote and the banknotes antecedent thereto are sent from the escrow unit 17.

<Second Mode of Operation of Banknote Handling Apparatus 10 in First Embodiment>

As a second mode of an operation of the banknote handling apparatus 10, the control unit 30 is configured to control the process such that, when a total sum of a money amount of a banknote, which is to be sent to the collecting and storing cassette 20 and is recognized by the recognition unit 16, and an amount-of-money data of banknotes in the collecting and storing cassette 20 exceeds a limit sum of the collecting and storing cassette 20, the destination of the banknote recognized by the recognition unit 16 is changed from the collecting and storing cassette 20 to another processing unit. Such a second embodiment of the operation of the banknote handling apparatus 10 is described with reference to the flowchart shown in FIG. 4. The flowchart shown in FIG. 4 shows a storing process for storing a banknote into the collecting and storing cassette 20, in the aforementioned deposit collecting process or the stacker collecting process.

Figure 4:
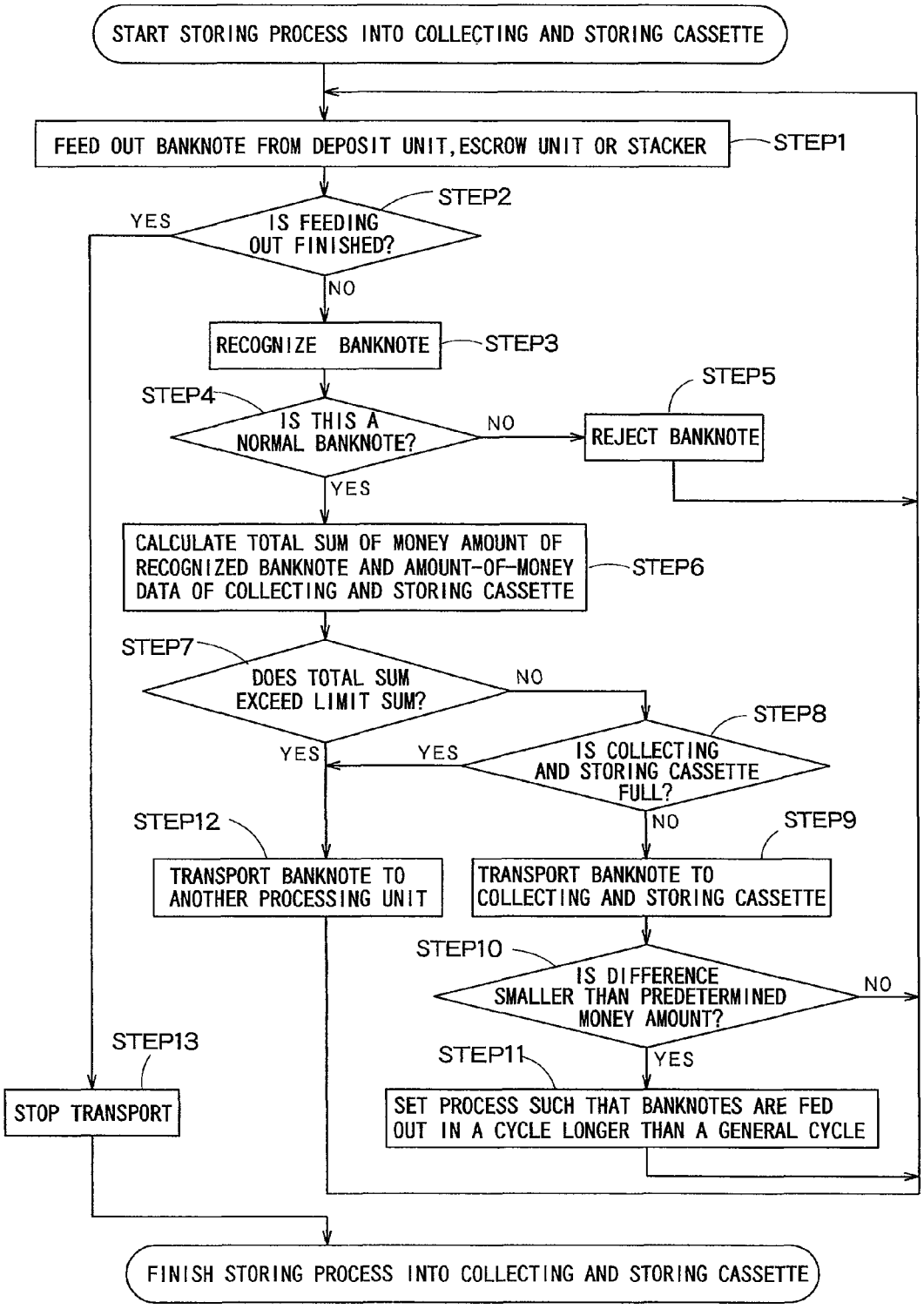
FIG. 4 is a flowchart showing a second mode of an operation of the banknote handling apparatus in the first embodiment of the present invention.

In the storing process for storing a banknote into the collecting and storing cassette 20 in the second mode of the operation of the banknote handling apparatus 10, since operations of STEP 1 to STEP 11 and STEP 13 in the flowchart of FIG. 4 are the same as those of STEP 1 to STEP 12 in the flowchart of FIG. 3, description thereof is omitted.

When a total sum of a money amount of a banknote recognized by the recognition unit 16 and an amount-of-money data of the collecting and storing cassette 20 exceeds a limit sum thereof ("YES" in STEP 7 of FIG. 4), the banknote is transported to a processing unit other than the collecting and storing cassette 20 (STEP 12 of FIG. 4). To be more specific, in this case, the banknote recognized by the recognition unit 16 is sent to the dispense unit 12, one of the respective stackers 22*a* to 22*d*, the escrow unit 17 or the reject storing unit 21. In the second mode of the operation of the banknote handling apparatus 10, the transport of a banknote is performed until the feeding of a banknote from the deposit unit 11, the escrow unit 17 or the stackers 22*a* to 22*d* is finished.

When the banknote recognized by the recognition unit 16 is transported to a processing unit other than the collecting and storing cassette 20 (STEP 12 of FIG. 4), this operation is displayed on the display unit 34. The display unit 34 makes a display for promoting a replacement of the collecting and storing cassette 20. Then, the collecting and storing cassette 20 is taken out from the housing 10*a* by a collecting agency, and the collection of the collecting and storing cassette 20 itself is performed by the collecting agency. Thereafter, the empty collecting and storing cassette 20 is returned to the housing 10*a*. In a case where the banknote recognized by the recognition unit 16 is sent to one of the stackers 22*a* to 22*d* or to the escrow unit 17, when the empty collecting and storing cassette 20 is returned to the housing 10*a*, the banknote is transported from the stackers 22*a* to 22*d* or the escrow unit 17 to the collecting and storing cassette 20.

After the feeding of a banknote from the deposit unit 11, the escrow unit 17 or the respective stackers 22*a* to 22*d* has been finished and the fed-out banknote has been transported to the collecting and storing cassette 20, the collecting and storing cassette 20 is optionally taken out by a collecting agency from the housing 10*a*, and the collection of the collecting and storing cassette 20 itself is performed by the collecting agency. Then, the empty collecting and storing cassette 20 is returned to the housing 10*a*.

In a case where there is performed the deposit process in which banknotes deposited into the inside of the housing 10*a* by the deposit unit 11 are stored in the respective stackers 22*a* to 22*d*, when each of the stackers 22*a* to 22*d* becomes full, a banknote deposited into the inside of the housing 10*a* is transported to the collecting and storing cassette 20, and is stored in the collecting and storing cassette 20. The storing process for storing a banknote into the collecting and storing cassette 20 in this case is the same as the process shown in the STEP 1 to STEP 13 of the flowchart of FIG. 4.

As described above, in the second mode of the operation of the banknote handling apparatus 10, as shown in the flowchart of FIG. 4, the control unit 30 is configured to control the process such that, when a total sum of a money amount of a banknote, which is to be sent to the collecting and storing cassette 20 and is recognized by the recognition unit 16, and an amount-of-money data of banknotes in the collecting and storing cassette 20 exceeds the limit sum of the collecting and storing cassette 20, the destination of the banknote recognized by the recognition unit 16 is changed from the collecting and storing cassette 20 to another processing unit.

<Third Mode of Operation of Banknote Handling Apparatus 10 in First Embodiment>

Figure 5:
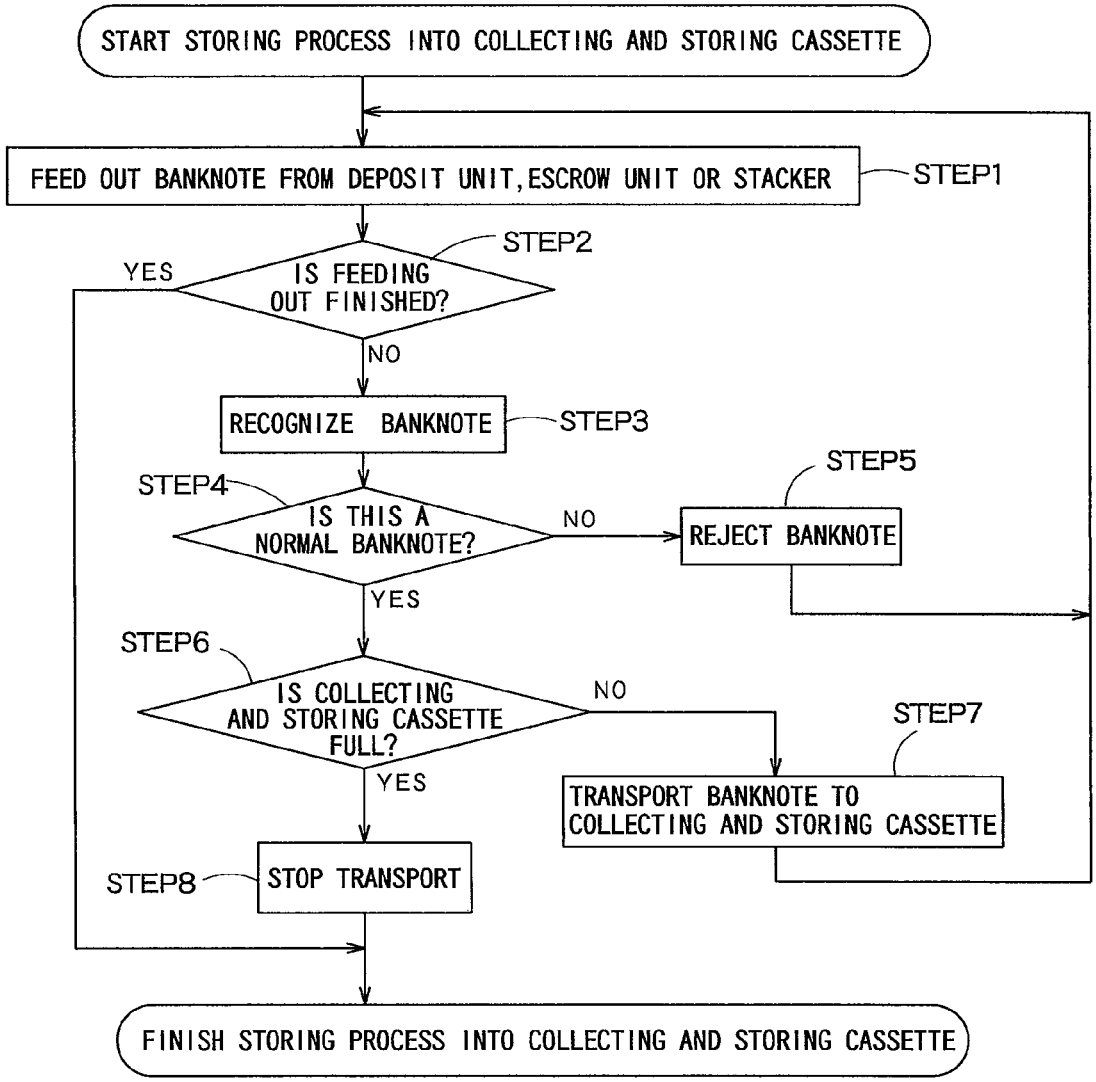
FIG. 5 is a flowchart showing a third mode of an operation of the banknote handling apparatus in the first embodiment of the present invention.
Figure 6:
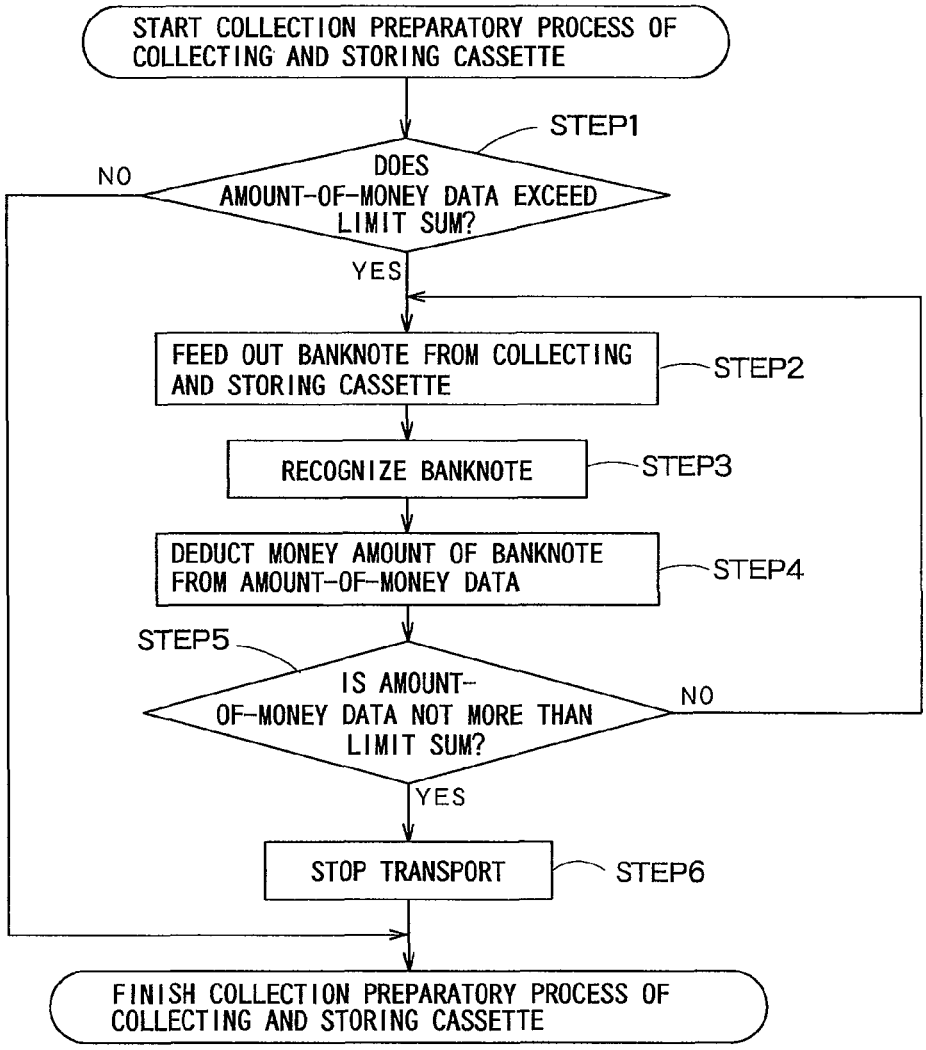
FIG. 6 is a flowchart showing the third mode of an operation of the banknote handling apparatus in the first embodiment of the present invention.

As a third mode of the operation of the banknote handling apparatus 10, the control unit 30 is configured to perform a collection preparatory process of the collecting and storing cassette 20, after a storing process for storing a banknote into the collecting and storing cassette 20 has been finished, and before a banknote collecting process for collecting the banknote is performed. The collection preparatory process of the collecting and storing cassette 20 is a process in which, when an amount-of-money data of banknotes in the collecting and storing cassette 20 is larger than a limit sum thereof, the banknotes stored in the collecting and storing cassette 20 are fed out to the transport unit 15, until the amount-of-money data of the collecting and storing cassette 20 becomes not more than the limit sum thereof. Such a third mode of the operation of the banknote handling apparatus 10 is described with reference to flowcharts shown in FIGS. 5 and 6. In more detail, FIG. 5 is a flowchart showing the storing process for storing a banknote into the collecting and storing cassette 20 in the third mode of the operation of the banknote handling apparatus 10. FIG. 6 is a flowchart showing the collection preparatory process of the collecting and storing cassette 20.

At first, the storing process for storing a banknote into the collecting and storing cassette 20 in the third mode of the operation of the banknote handling apparatus 10 is described with reference to the flowchart shown in FIG. 5. The flowchart shown in FIG. 5 shows the storing process for storing a banknote into the collecting and storing cassette 20, in the aforementioned deposit collecting process or the stacker collecting process.

The storing process for storing a banknote into the collecting and storing cassette 20 shown in the flowchart of FIG. 5 is substantially the same as the storing process for storing a banknote into the collecting and storing cassette 20 shown in the flowchart of FIG. 3. However, unlike the storing process for storing a banknote into the collecting and storing cassette 20 shown in FIG. 3, the comparison between a total sum of a money amount of a banknote recognized by the recognition unit 16 and an amount-of-money data of the collecting and storing cassette 20, and a limit sum thereof is not performed. Namely, in the storing process for storing a banknote into the collecting and storing cassette 20 shown in the flowchart of FIG. 5, when a banknote recognized by the recognition unit 16 is a normal banknote ("YES" in STEP 4 of FIG. 5), whether the collecting and storing cassette 20 is full or not is detected (STEP 6 of FIG. 5). When the collecting and storing cassette 20 is not full ("NO" in STEP 6 of FIG. 5), the banknote is transported to the collecting and storing cassette 20 regardless of an amount-of-money data of the collecting and storing cassette 20 (STEP 7 of FIG. 5). After the feeding of a banknote from the deposit unit 11, the escrow unit 17 or the respective stackers 22*a* to 22*d* has been finished ("YES" in STEP 2 of FIG. 5), the transport of a banknote is stopped (STEP 8 of FIG. 5), and the storing process of a banknote into the collecting and storing cassette 20 is finished.

In stead of the process shown in the flowchart of FIG. 5, the following process is possible as the storing process for storing a banknote into the collecting and storing cassette 20 in the third mode of the operation of the banknote handling apparatus 10. Namely, when the collecting and storing cassette 20 becomes full, the destination of a banknote fed out from the deposit unit 11, the escrow unit 17 or the respective stackers 22*a* to 22*d* is changed from the collecting and storing cassette 20 to another processing unit.

Next, the collection preparatory process of the collecting and storing cassette 20 in the third mode of the operation of the banknote handling apparatus 10 is described with reference to the flowchart shown in FIG. 6.

In the collection preparatory process of the collecting and storing cassette 20, the control unit 30 firstly judges whether an amount-of-money data of the collecting and storing cassette 20 is larger than a limit sum thereof (STEP 1 of FIG. 6). When the amount-of-money data of the collecting and storing cassette 20 is not more than the limit sum thereof ("NO" in STEP 1 of FIG. 6), the collection preparatory process of the collecting and storing cassette 20 is finished. On the other hand, when the amount-of-money data of the collecting and storing cassette 20 is larger than the limit sum thereof ("YES" in STEP 1 of FIG. 6), a banknote stored in the collecting and storing cassette 20 is fed out to the transport unit 15, until the amount-of-money data of the collecting and storing cassette 20 becomes not more than the limit sum thereof. In more detail, banknotes are fed out, one by one, from the collecting and storing cassette 20 (STEP 2 of FIG. 6), each fed-out banknote is recognized by the recognition unit 16 (STEP 3 of FIG. 6), and the control unit 30 deducts the money amount of the fed-out banknote from the amount-of-money data of the collecting and storing cassette 20 (STEP 4 of FIG. 6). For each time when a banknote is fed out, the control unit 30 judges whether the amount-of-money data from which the money amount of the fed-out banknote is deducted, is within the limit sum or not (STEP 5 of FIG. 6).

When the amount-of-money data after the deduction becomes not more than the limit sum ("YES" in STEP 5 of FIG. 6), the transport of the banknote is stopped (STEP 6 of FIG. 6), and the collection preparatory process of the collecting and storing cassette 20 is finished. At this time, when a banknote, which is not yet recognized by the recognition unit 16, is placed on the transport unit 15, such a banknote is returned to the collecting and storing cassette 20. On the other hand, when the amount-of-money data after the deduction is larger than the limit sum ("NO" in STEP 5 of FIG. 6), the feeding of a banknote is continuously performed until amount-of-money data of the collecting and storing cassette 20 becomes not more than the limit sum thereof.

When the collection preparatory process of the collecting and storing cassette 20 shown in the flowchart of FIG. 6 is finished, the collecting and storing cassette 20 is optionally taken out by a collecting agency from the housing 10*a*, and the collection of the collecting and storing cassette 20 itself is performed by the collecting agency. Then, the empty collecting and storing cassette 20 is returned to the housing 10*a*.

As described above, in the third mode of the operation of the banknote handling apparatus 10 in the first embodiment, as shown in the flowcharts of FIGS. 5 and 6, the control unit 30 is configured to perform the collection preparatory process of the collecting and storing cassette 20, after the storing process for storing a banknote into the collecting and storing cassette 20 has been finished, and before the collecting process for collecting the banknote is performed.

In the aforementioned first to third modes of the operation of the banknote handling apparatus 10 in the first embodiment, the control unit 30 may calculate a difference between an amount-of-money data of banknotes in the collecting and storing cassette 20 and a limit sum thereof, and the display unit 34 may display the difference. In this case, an operator can designate a money amount of a deposit collection, while watching the difference.

In addition, when the collecting and storing cassette 20 is returned into the housing 10*a* of the banknote handling apparatus 10 after the banknote collecting process has been performed, whether the returned collecting and storing cassette 20 is empty or not may be confirmed. To be more specific, the banknote handling apparatus 10 is provided with a detecting means such as a sensor for detecting whether the collecting and storing cassette 20 is empty or not. Thus, when the collecting and storing cassette 20 is returned into the housing 10*a* of the banknote handling apparatus 10, whether the collecting and storing cassette 20 is empty or not can be detected by the detecting means.

When the collecting and storing cassette 20 is returned into the housing 10*a* of the banknote handling apparatus 10 after the banknote collecting process has been performed, there is a case in which the operation is performed such that the collecting and storing cassette 20 is not empty. In this case, when the collecting and storing cassette 20 is returned into the housing 10*a* of the banknote handling apparatus 10 after the banknote collecting process has been performed, an amount-of-money data of the returned collecting and storing cassette 20 is confirmed. More specifically, the amount-of-money data of the collecting and storing cassette 20 upon being returned into the housing 10*a* can be manually inputted by an operator through the operation unit 35. Alternatively, the following process is possible. Namely, when the collecting and storing cassette 20 is returned into the housing 10*a*, an ID of the collecting and storing cassette 20 is acquired, and the control unit 30 acquires amount-of-money data information relating to the ID. As a further alternative method, when the collecting and storing cassette 20 is returned into the housing 10*a*, it is possible to acquire amount-of-money data information of the collecting and storing cassette 20 from a memory medium associated with the collecting and storing cassette 20.

In the banknote handling apparatus 10 in this embodiment, there is used the collecting and storing cassette 20 which is of a type that can feed banknotes stored in the collecting and storing cassette 20 to the transport unit 15. However, as another type of the collecting and storing cassette, there may be used a collecting and storing cassette of a type that cannot feed banknotes stored in the collecting and storing cassette to the transport unit 15. In addition, in the banknote handling apparatus 10 in this embodiment, although the plurality of stackers 22*a* to 22*d* for storing and feeding banknotes are provided, these stackers 22*a* to 22*d* may be omitted.

In addition, in the banknote handling apparatus 10 in this embodiment, the plurality of collecting and storing cassettes 20 may be provided. In this case, in a case where the destination of a banknote is changed from the collecting and storing cassette 20 to another processing unit in the second mode of the operation of the banknote handling apparatus 10, or in a case where a banknote is fed out from the collecting and storing cassette 20 to the transport unit 15 and the fed-out banknote is transported to another processing unit in the third mode of the operation of the banknote handling apparatus 10, another collecting and storing cassette 20 can be used as another processing unit, when an amount-of-money data of banknotes in the one collecting and storing cassette 20 reaches a limit sum thereof.

As described above, in the banknote handling apparatus 10 in this embodiment, the memory unit 37 is configured to store an amount-of-money data of banknotes stored in the collecting and storing cassette 20, and a limit sum which is a money amount of banknotes that can be stored in the collecting and storing cassette 20. Based on the amount-of-money data and the limit sum respectively stored in the memory unit 37, the control unit 30 performs a control such that the amount-of-money data does not exceed the limit sum, in the collecting process in which banknotes in the collecting and storing cassette 20 are taken out from the housing 10*a* of the banknote handling apparatus 10. Thus, according to the banknote handling apparatus 10 in this embodiment, the banknote collecting process can be performed, in a state where the amount-of-money data of banknotes stored in the collecting and storing cassette 20 is certainly not more than the limit sum thereof, so that a money amount of banknotes to be stored in the collecting and storing cassette 20 can be controlled.

In the first mode of the operation of the banknote handling apparatus 10 in this embodiment, the control unit 30 is configured to control the process such that, when a total sum of a money amount of a banknote, which is to be sent to the collecting and storing cassette 20 and is recognized by the recognition unit 16, and an amount-of-money data of the collecting and storing cassette 20 exceeds a limit sum, the transport of the banknote from the transport unit 15 to the collecting and storing cassette 20 is stopped. In addition, when the transport of a banknote to the collecting and storing cassette 20 becomes possible after the banknote collecting process has been performed, the control unit 30 is configured to resume the transport of a banknote to the collecting and storing cassette 20.

In the second mode of the operation of the banknote handling apparatus 10 in this embodiment, the control unit 30 is configured to control the process such that, when a total sum of a money amount of a banknote, which is to be sent to the collecting and storing cassette 20 and is recognized by the recognition unit 16, and an amount-of-money data of the collecting and storing cassette 20 exceeds a limit sum, the destination of the banknote recognized by the recognition unit 16 is changed from the collecting and storing cassette 20 to another processing unit. The other processing unit is any one of the dispense unit 12, the escrow unit 17, the stackers (storing and feeding units) 22*a* to 22*d*, and the reject storing unit 21. When the plurality of collecting and storing cassettes are provided, the other processing unit may be used as another collecting and storing cassette. In a case where the other processing unit is the escrow unit 17 or the stackers 22*a* to 22*d*, when the transport of a banknote to the collecting and storing cassette 20 becomes possible after the banknote collecting process has been performed, the control unit 30 performs a control such that a banknote is fed out from the escrow unit 17 or the stackers 22*a* to 22*d*, and the fed-out banknote is transported to the collecting and storing cassette 20.

In the third mode of the operation of the banknote handling apparatus 10 in this embodiment, the collecting and storing cassette 20 can feed a banknote stored in the collecting and storing caste 20 to the transport unit 15. The control unit 30 is configured to perform a control such that, before the banknote collecting process is performed, when an amount-of-money data of the collecting and storing cassette 20 is larger than a limit sum, a banknote stored in the collecting and storing cassette 20 is fed out to the transport unit 15, and the fed-out banknote is transported to another processing unit, so that the money amount of banknotes stored in the collecting and storing cassette 20 is not more than the limit sum. At this time, the control unit 30 performs a control such that the banknote fed out from the collecting and storing cassette 20 to the transport unit 15 is transported to any one of the dispense unit 12, the escrow unit 17, the stackers (storing and feeding units) 22*a* to 22*d*, and the reject storing unit 21. When the plurality of collecting and storing cassettes are provided, the control unit 30 may perform a control in which the banknote fed out from the one collecting and storing cassette is transported to the other collecting and storing cassette. In addition, in a case where the banknote fed out from the collecting and storing cassette 20 to the transport unit 15 is transported to the escrow unit 17 or the stackers (storing and feeding units) 22*a* to 22*d*, when the transport of a banknote to the collecting and storing cassette 20 becomes possible after the banknote collecting process has been performed, the control unit 30 performs a control such that a banknote is fed out from the escrow unit 17 or the stackers 22*a* to 22*d*, and the fed-out banknote is transported to the collecting and storing cassette 20.

Second Embodiment

Figure 7:
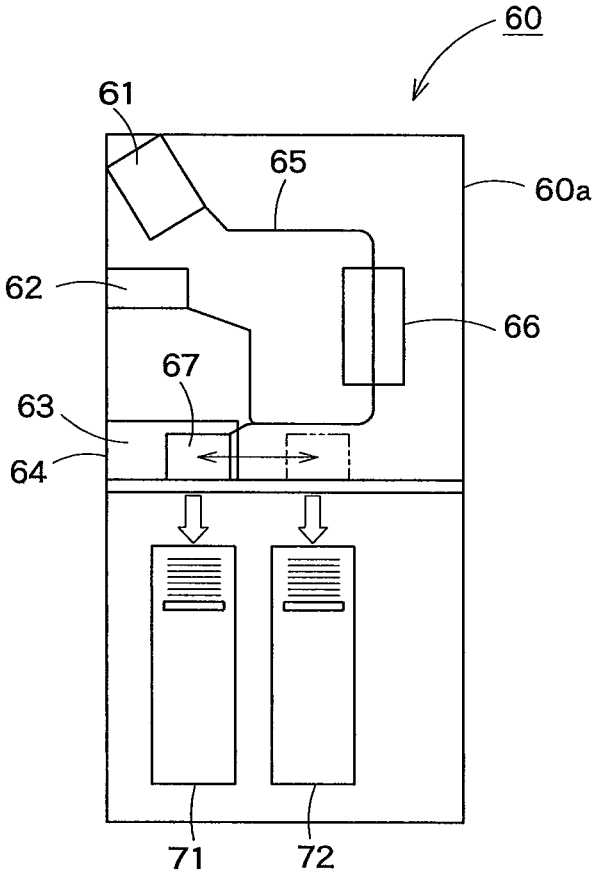
FIG. 7 is a structural view schematically showing a structure of the banknote handling apparatus in a second embodiment of the present invention.
Figure 8:
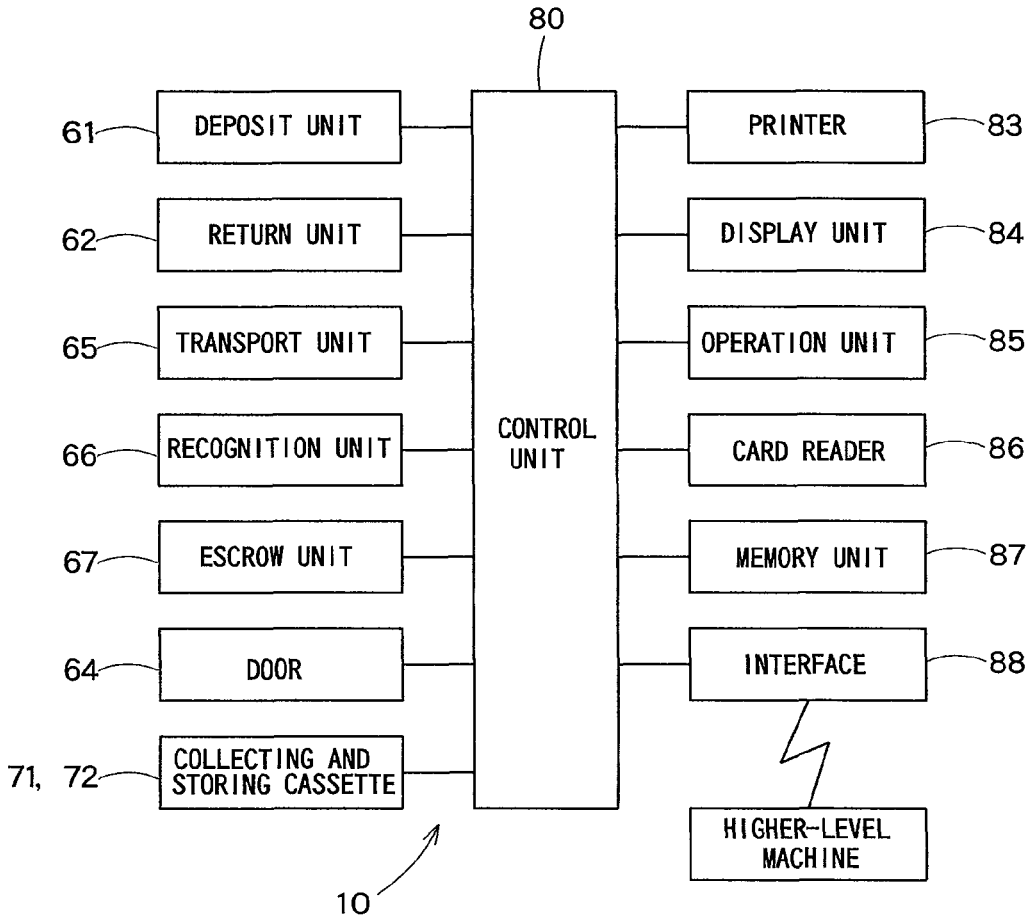
FIG. 8 is a control block diagram of the banknote handling apparatus shown in FIG. 7.
Figure 9:
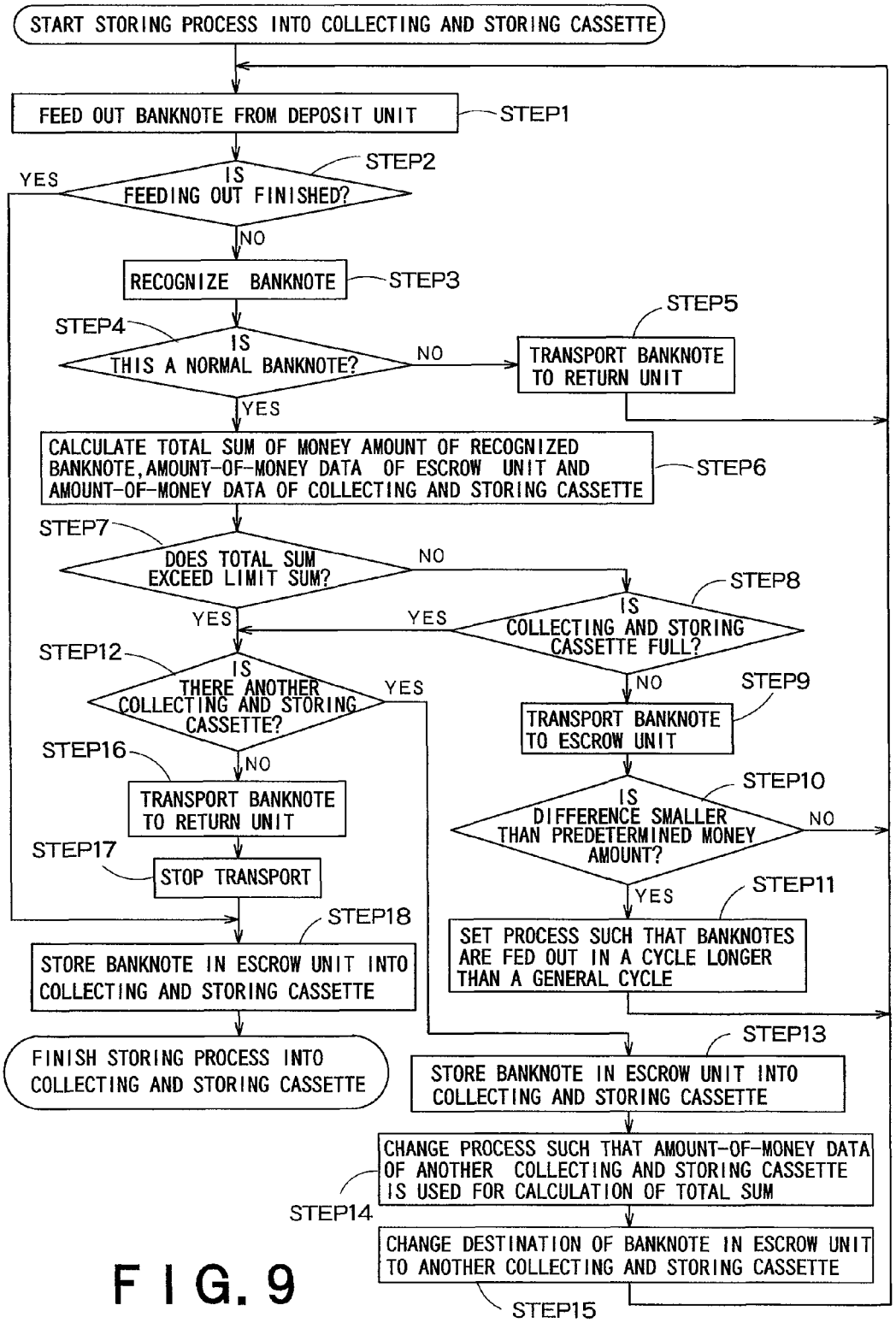
FIG. 9 is a flowchart showing an operation of the banknote handling apparatus in the second embodiment of the present invention.

A banknote handling apparatus in a second embodiment of the present invention is described herebelow with reference to the drawings. FIGS. 7 to 9 show the banknote handling apparatus in the second embodiment of the present invention.

As shown in FIG. 7, the banknote handling apparatus 60 includes a housing 60*a* of a substantially rectangular parallelepiped shape, a deposit unit 61 for taking banknotes, one by one, into an inside of the housing 60*a* from an outside thereof, and a return unit 62 for returning a banknote from the inside of the housing 60*a* to the outside thereof. In addition, a transport unit 65 for transporting a banknote is provided inside the housing 60*a*. A banknote taken into the inside of the housing 60*a* by the deposit unit 61 is transported by the transport unit 65. The deposit unit 61 has a feeding mechanism (not shown) for feeding banknotes, one by one, which are stacked in the deposit unit 61, to the transport unit 65. Banknotes, which have been transported from the transport unit 65 to the return unit 62, are stacked in the return unit 62. The return unit 62 is provided with a shutter that opens and closes the return unit 62. By opening the shutter, it is possible to access the return unit 62 from outside, and a banknote can be taken out from the return unit 62.

The transport unit 65 is provided with a recognition unit 66 that recognizes a denomination, an authenticity, a fitness and so on of a banknote that is transported by the transport unit 65. A recognition result of a banknote recognized by the recognition unit 66 is sent to a control unit 80 which will be described below. Inside the housing 60*a*, an escrow unit 67 is connected to the transport unit 65. A banknote, which has been taken by the deposit unit 61 into the inside of the housing 60*a* and recognized by the recognition unit 66, is sent to the escrow unit 67, and is escrowed in the escrow unit 67. The escrow unit 67 is provided on a banknote return opening 63 for returning a banknote, and the banknote return opening 63 is provided with an openable and closable door 64. When a banknote in the escrow unit 67 is returned, a wall surface of the escrow unit 67 on a front side of the apparatus is opened, and an operator can take out the banknote from the door 64. The door 64 is automatically opened when it becomes possible to take out a banknote.

Inside the housing 60*a*, two collecting and storing cassettes 71 and 72 are arranged in a line, below the escrow unit 67. The escrow unit 67 can be reciprocated between a position directly above the collecting and storing cassette 71 and a position directly above the collecting and storing cassette 72. Banknotes can be collectively sent from the escrow unit 67 to the collecting and storing cassette 71 or to the collecting and storing cassette 72. These collecting and storing cassettes 71 and 72 are detachably attached to the inside of the housing 60*a*, and are configured to store banknotes sent from the transport unit 65 in a stacked manner. When a collecting agency takes out the collecting and storing cassettes 71 and 72 from the housing 60*a* so as to collect the collecting and storing cassettes 71 and 72 themselves, a banknote collecting process for collecting banknotes stored in the collecting and storing cassettes 71 and 72 can be performed.

Next, the control unit 80 configured to control the respective constituent elements in the banknote handling apparatus 60 is described with reference to FIG. 8. The control unit 80 is located inside the housing 60*a* of the banknote handling apparatus 60.

As shown in FIG. 8, connected to the control unit 80 are the respective constituent elements of the banknote handling apparatus 60 (e.g., the deposit unit 61, the return unit 62, the transport unit 65, the recognition unit 66, the escrow unit 67, the door 64, the collecting and storing cassettes 71 and 72 and so on), a printer 83, a display unit 84, an operation unit 85, a card reader 86, a memory unit 87, an interface 88 and so on.

Information such as a banknote recognition result of the recognition unit 66 is sent to the control unit 80. Further, an ID of an ID card of an operator and IDs of the collecting and storing cassettes 71 and 72, which are read by the card reader 86, are sent to the control unit 80. Furthermore, a command of an operator is sent to the control unit 80 through the operation unit 85.

In addition, the control unit 80 is configured to control the respective constituent elements of the banknote handling apparatus 60, and to control the printer 83, the display unit 84 and so on. Further, the control unit 80 can communicate with a higher-level machine such as a host computer, through the interface 88 connected to the control unit 80. The memory unit 87 is connected to the control unit 80, whereby a banknote recognition result and various information can be stored. In the banknote handling apparatus 60 in this embodiment, the memory unit 87 is configured to store an amount-of-money data of banknotes actually stored in each of the respective collecting and storing cassettes 71 and 72, and a limit sum which is a money amount of banknotes that can be stored in each of the collecting and storing cassettes 71 and 72. The limit sum stored in the memory unit 87 can be set as a given money amount, by an operator through the operation unit 85. However, an upper limit of the limit sum is a value obtained by multiplying the number of banknotes which can be stored in each of the collecting and storing cassette 71 and 72 and a largest denomination of a banknote. In addition, the memory unit 87 is configured to store the number of banknotes which can be stored in each of the collecting and storing cassettes 71 and 72 (the number of banknotes with which each of the collecting and storing cassettes 71 and 72 becomes full).

Next, an operation of the banknote handling apparatus 60 as structured above is described.

At first, a banknote deposit and collecting process performed by the banknote handling apparatus 60 is briefly described.

In the banknote deposit and collecting process performed by the banknote handling apparatus 60, banknotes, which have been fed one by one from the deposit unit 61 to the inside of the housing 60*a*, are transported to the recognition unit 66, and the recognition unit 66 recognizes a denomination, an authenticity and so on of the banknotes. A banknote which is recognized as a normal banknote is stored in the escrow unit 67. On the other hand, a banknote which is recognized as an unacceptable banknote is returned to the return unit 62. After a "confirmation" has been inputted through the operation unit 85, banknotes escrowed in the escrow unit 67 are collectively sent to the collecting and storing cassette 71 or to the collecting and storing cassette 72.

In the banknote handling apparatus 60 in this embodiment, as described above, an amount-of-money data of banknotes stored in each of the collecting and storing cassettes 71 and 72, and a limit sum which is a money amount of banknotes that can be stored in each of the collecting and storing cassettes 71 and 72 are stored in the memory unit 87. When a banknote collecting process is performed, the control unit 80 controls the escrow unit 67, such that the amount-of-money data of each of the collecting and storing cassettes 71 and 72 does not exceed the limit sum. Similarly to the first embodiment, the collecting and storing unit is not limited to a cassette type unit. Instead of using the collecting and storing cassettes 71 and 72, pouch-type collecting and storing units may be replaced, or banknotes may be directly taken out from collecting and storing units fixed on the housing 60*a*. Namely, the banknote collecting process is a process by which a banknote is taken out from the housing 60*a*.

In the second embodiment, when an operator inputs a start of the deposit collecting process through the operation unit 85, there is performed a process shown in the flowchart of FIG. 9. An operation of the banknote handling apparatus 60 is described in detail below.

When a storing process for storing a banknote to the collecting and storing cassettes 71 and 72 is started, banknotes are fed out, one by one, from the deposit unit 61 (STEP 1 of FIG. 9). In the flowchart shown in FIG. 9, a process for one banknote is shown. However, in general, a subsequent banknote is continuously fed after the first banknote has been fed out. Namely, the next banknote is fed out, without waiting the completion of the series of processes shown in the flowchart of FIG. 9.

After the feeding of a banknote from the deposit unit 61 has been finished ("YES" in STEP 2 of FIG. 9), banknotes in the escrow unit 67 are collectively sent to one of the two collecting and storing cassettes 71 and 72 (the collecting and storing cassette 71 is taken as an example in the following description), and are stored in the collecting and storing cassette 71 (STEP 18 of FIG. 9). In this manner, the storing process for storing a banknote into the collecting and storing cassette 71 is finished. On the other hand, when the feeding of a banknote from the deposit unit 61 is not finished ("NO" in STEP 2 of FIG. 9), a denomination, an authenticity and so on of the banknote is recognized by the recognition unit 66 (STEP 3 of FIG. 9).

When the banknote recognized by the recognition unit 66 is not a normal banknote ("NO" in STEP 4 of FIG. 9), the banknote is sent to the return unit 62 so as to be returned to the operator (STEP 5 of FIG. 9). On the other hand, when the banknote recognized by the recognition unit 66 is a normal banknote, ("YES" in STEP 4 of FIG. 9), the control unit 80 calculates a total sum of a money amount of the recognized banknote, an amount-of-money data of the escrow unit 67, and an amount-of-money data of the collecting and storing cassette 71 (STEP 6 of FIG. 9). Included in the amount-of-money data of the escrow unit 67 is a money amount of a banknote which is to be stored in the escrow unit 67, and is being transported by the transport unit 65 after having been recognized by the recognition unit 66.

When the total sum is not more than the limit sum ("NO" in STEP 7 of FIG. 9), whether the collecting and storing cassette 71 is full or not is detected (STEP 8 of FIG. 9). When the collecting and storing cassette 71 is not full ("NO" in STEP 8 of FIG. 9), the banknote is transported to the escrow unit 67 (STEP 9 of FIG. 9). At this time, when a difference between the total sum of the amount-of-money data of the escrow unit 67 and the amount-of-money data of the collecting and storing cassette 71, and the limit sum is smaller than a predetermined money amount ("YES" in STEP 10 of FIG. 9), the control unit 80 controls the process such that banknotes are fed out in a cycle longer than a general cycle. Namely, when a difference between the total sum of the amount-of-money data of the escrow unit 67 and the amount-of-money data of the collecting and storing cassette 71, and the limit sum becomes small, an interval between a time at which one banknote is fed out and a timing at which a subsequent banknote is fed out is increased. Alternatively, a subsequent banknote may be fed out, after the series of processes shown in the flowchart of FIG. 9 have been finished for one banknote.

On the other hand, when the total sum of the money amount of the recognized banknote, the amount-of-money data of the escrow unit 67, and the amount-of-money data of the collecting and storing cassette 71 exceeds the limit sum ("YES" in STEP 7 of FIG. 9), or when the total sum is not more than the limit sum but the collecting and storing cassette 71 is full ("YES" in STEP 8 of FIG. 9), whether there is another available collecting and storing cassette or not is judged by the control unit 80 (STEP 12 of FIG. 9). In the banknote handling apparatus 60 shown in FIG. 7, since there is the other collecting and storing cassette 72 in addition to the collecting and storing cassette 71, it is judged that there is another collecting and storing cassette ("YES" in STEP 12 of FIG. 9). In this case, the banknote in the escrow unit 67 is stored into the collecting and storing cassette 71 (STEP 13 of FIG. 9). In addition, when the total sum used in the STEP 6 of FIG. 9 is calculated, the change is performed such that, not the amount-of-money data of the collecting and storing cassette 71, but an amount-of-money data of the collecting and storing cassette 72 is used (STEP 14 of FIG. 9). Then, the destination of a banknote in the escrow unit 67 is changed from the collecting and storing cassette 71 to the collecting and storing cassette 72 (STEP 15 of FIG. 9). Thereafter, feeding of a banknote from the deposit unit 61 is continuously performed.

When only one collecting and storing cassette is accommodated in the banknote handling apparatus ("NO" in STEP 12 of FIG. 9), the banknote recognized by the recognition unit 66 is transported to the return unit 62 (STEP 16 of FIG. 9). Thereafter, the transport of a banknote is stopped (STEP 17 of FIG. 9), and banknotes in the escrow unit 67 are collectively sent to the collecting and storing cassette so as to be stored in this collecting and storing cassette (STEP 18 of FIG. 9).

Instead of the processes shown in STEPs 6 and 7 in the flowchart of FIG. 9, the following process is possible. Namely, the control unit 80 previously calculates a difference between the total sum of the amount-of-money data of the escrow unit 67 and the amount-of-money data of the collecting and storing cassette 71, and the limit sum, and judges whether the money amount of the banknote recognized by the recognition unit 66 is not more than the difference or not. That is to say, in this case, when the money amount of the banknote recognized by the recognition unit 66 exceeds the difference, the destination of a banknote in the escrow unit 66 is changed to the other collecting and storing cassette 72 (STEP 13 to STEP 15 of FIG. 9), or the transport of the banknote is stopped (STEP 18 of FIG. 9).

When the destination of a banknote in the escrow unit 67 is changed to the other collecting and storing cassette 72 or the transport of the banknote is stopped, this operation is displayed on the display unit 84. The display unit 84 makes a display for promoting a replacement of the collecting and storing cassette 71. Then, the collecting and storing cassette 71 is taken out from the housing 60*a* by a collecting agency, and the collection of the collecting and storing cassette 71 itself is performed by the collecting agency. Thereafter, the empty collecting and storing cassette 71 is returned to the housing 60*a*.

After the feeding of a banknote from the deposit unit 61 has been finished, and the fed-out banknote has been transported to the collecting and storing cassette 71, the collecting and storing cassettes 71 and 72 are optionally taken out from the housing 60*a* by the collecting agency, and the collection of the collecting and storing cassettes 71 and 72 themselves is performed by the collecting agency. Thereafter, the empty collecting and storing cassettes 71 and 72 are returned to the housing 60*a*.

As described above, in the banknote handling apparatus 60 in the second embodiment, the memory unit 87 is configured to store an amount-of-money data of banknotes stored in each of the collecting and storing cassettes 71 and 72, an amount-of-money data of banknotes stored in the escrow unit 67, and a limit sum which is a money amount of banknotes that can be stored in each of the collecting and storing cassettes 71 and 72. Based on the total sum of the amount-of-money data and the limit sum respectively stored in the memory unit 87, the control unit 80 performs a control such that the amount-of-money data of each of the collecting and storing cassettes 71 and 72 does not exceed the limit sum, upon the banknote collecting process. Thus, according to the banknote handling apparatus 60 in the second embodiment, the banknote collecting process can be performed, in a state where the amount-of-money data of banknotes stored in each of the collecting and storing cassettes 71 and 72 is certainly not more than the limit sum, so that a money amount of banknotes to be stored in each of the collecting and storing cassettes 71 and 72 can be controlled.

In the operation of the banknote handling apparatus 60 in the second embodiment, instead of the process shown in the flowchart of FIG. 9, the following process is possible. At first, regardless of an amount-of-money data of the escrow unit 67 and an amount-of-money data of each of the collecting and storing cassettes 71 and 72, all the banknotes, which have been fed out from the deposit unit 61 to the inside of the housing 60*a* and recognized as normal banknotes by the recognition unit 66, are transported to the escrow unit 67. In this case, after all the banknotes have been fed from the deposit unit 61 to the inside of the housing 60*a*, when a total sum of a money amount of the banknotes transported to the escrow unit 67 and an amount-of-money data of banknotes in either one of the collecting and storing cassettes 71 and 72 (hereinafter, the collecting and storing cassette 71 is taken as an example) becomes larger than a limit sum of the collecting and storing cassette 71, the control unit 80 performs a control such that the transport of a banknote from the escrow unit 67 to the collecting and storing cassette 71 is stopped, and banknotes are collectively returned. To be more specific, when the total sum of the money amount of the banknotes transported to the escrow unit 67 and the amount-of-money data of the banknotes in the collecting and storing cassette 71 is larger than the limit sum of the collecting and storing cassette 71, the door 64 is opened, and the wall surface of the escrow unit 67 on the front side of the apparatus is opened, so that an operator can take out the banknotes from the door 64. In this manner, the banknotes escrowed in the escrow unit 67 are returned to the outside of the housing 60*a*.

In addition, as another operation of the banknote handling apparatus 60 in the second embodiment, the following process is possible. At first, regardless of an amount-of-money data of the escrow unit 67 and an amount-of-money data of each of the collecting and storing cassettes 71 and 72, all the banknotes, which have been fed out from the deposit unit 61 to the inside of the housing 60*a* and recognized as normal banknotes by the recognition unit 66, are transported to the escrow unit 67. After all the banknotes have been fed out from the deposit unit 61 to the inside of the housing 60*a*, when a total sum of a money amount of the banknotes transported to the escrow unit 67 and an amount-of-money data of banknotes in the collecting and storing cassette 71 becomes larger than a limit sum of the collecting and storing cassette 71, the control unit 80 performs a control such that the banknotes are stored in the other collecting and storing cassette 72 instead of the collecting and storing cassette 71. To be more specific, when the total sum of the money amount of the banknotes transported to the escrow unit 67 and the amount-of-money data of banknotes in the collecting and storing cassette 72 is not more than the limit sum of the collecting and storing cassette 72, the escrow unit 67 is moved from the position directly above the collecting and storing cassette 71 to the position directly above the collecting and storing cassette 72, and the banknotes are collectively sent from the escrow unit 67 to the collecting and storing cassette 72. On the other hand, when the total sum of the money amount of the banknotes transported to the escrow unit 67 and the amount-of-money data of banknotes in the collecting and storing cassette 72 is larger than the limit sum of the collecting and storing cassette 72, the banknotes in the escrow unit 67 are collectively returned.

In addition, in the aforementioned banknote handling apparatus 60 in the second embodiment, similarly to the display unit 34 of the banknote handling apparatus 10 in the first embodiment, the display unit 84 may display a difference between an amount-of-money data of banknotes in each of the collecting and storing cassettes 71 and 72 and a limit sum thereof. In addition, similarly to the banknote handling apparatus 10 in the first embodiment, when the collecting and storing cassettes 71 and 72 are returned into the housing 60*a* of the banknote handling apparatus 60 after the banknote collecting process, whether a banknote remains in each of the collecting and storing cassettes 71 and 72 or not, and an amount-of-money data thereof may be confirmed. A method of confirming whether a banknote remains in each of the collecting and storing cassettes 71 and 72 or not and an amount-of-money data thereof is the same as the method of confirming whether a banknote remains in the collecting and storing cassette 20 of the banknote handling apparatus 10 and an amount-of-money data thereof.

In the aforementioned first and second embodiments, although the banknote handling apparatus for handling a banknote is described, money to be processed by the money handling apparatus of the present invention is not limited to a banknote. The money handling apparatus of the present invention may handle a coin instead of a banknote.

The invention claimed is:

1. A money handling apparatus comprising:

a feeding unit configured to feed out money one by one, the money including at least two denominations;

a transport unit connected to the feeding unit, the transport unit being configured to transport the money;

a recognition unit provided on the transport unit, the recognition unit being configured to recognize respective denominations of the money transported by the transport unit;

a collecting and storing unit provided in a housing of the money handling apparatus, the collecting and storing unit being removable from the housing and configured to store the money transported by the transport unit in a denomination mixed state;

a memory unit configured to store an amount-of-money data, which is a sum of money stored in the collecting and storing unit, and a limit sum, which is a sum of money that can be stored in the collecting and storing unit; and a control unit configured to perform a control such that the amount-of-money data does not exceed the limit sum, based on the amount-of-money data and the limit sum respectively stored in the memory unit, when there is performed a money collecting process in which money in the denomination mixed state stored in the collecting and storing unit is removed from the housing.

2. The money handling apparatus according to claim 1, wherein the control unit is configured to control the process such that when a total sum of the sum of the money, which is to be sent to the collecting and storing unit and is recognized by the recognition unit, and the amount-of-money data becomes larger than the limit sum, the transport of the money from the transport unit to the collecting and storing unit is stopped.

3. The money handling apparatus according to claim 2, wherein when the transport of the money to the collecting and storing unit becomes possible after the money collecting process has been performed, the control unit performs a control such that the transport of the money to the collecting and storing unit is resumed.

4. The money handling apparatus according to claim 1, wherein the control unit is configured to control the process such that when a total sum of the sum of the money, which is to be sent to the collecting and storing unit and is recognized by the recognition unit, and the amount-of-money data becomes larger than the limit sum, the destination of the money recognized by the recognition unit is changed from the collecting and storing unit to another processing unit.

5. The money handling apparatus according to claim 4, wherein the other processing unit is a dispense unit configured to take out money to an outside of the housing of the money handling apparatus.

6. The money handling apparatus according to claim 4, wherein a plurality of the collecting and storing units are provided, and when money transported by the transport unit is stored into one of the plurality of collecting and storing units, the control unit makes another collecting and storing unit serve as the other processing unit.

7. The money handling apparatus according to claim 4, wherein the other processing unit is a storing and feeding unit provided in the housing of the money handling apparatus, the storing and feeding unit being configured to store and feed money.

8. The money handling apparatus according to claim 7, wherein when the transport of money to the collecting and storing unit becomes possible after the money collecting process has been performed, the control unit performs a control such that money is fed out from the storing and feeding unit, and the transport of the money to the collecting and storing unit is resumed.

9. The money handling apparatus according to claim 1, further comprising a display unit configured to display a difference between the amount-of-money data and the limit sum.

10. The money handling apparatus according to claim 1, wherein after the money collecting process has been performed and before the transport of money to the collecting and storing unit becomes possible, there is performed a confirmation as to whether there remains money in the collecting and storing unit or not, or as to an amount-of-money data thereof.

11. A money handling apparatus comprising:

a feeding unit configured to feed out money one by one;

a transport unit connected to the feeding unit, the transport unit being configured to transport the money;

a recognition unit provided on the transport unit, the recognition unit being configured to recognize at least a denomination of the money transported by the transport unit;

a collecting and storing unit provided in a housing of the money handling apparatus, the collecting and storing unit being configured to store the money transported by the transport unit;

a memory unit configured to store an amount-of-money data which is a sum of money stored in the collecting and storing unit, and a limit sum, which is a sum of money that can be stored in the collecting and storing unit; and a control unit configured to perform a control such that the amount-of-money data does not exceed the limit sum, based on the amount-of-money data and the limit sum respectively stored in the memory unit, when there is performed a money collecting process in which money in the collecting and storing unit is taken out from the housing of the money handling apparatus, wherein the collecting and storing unit feeds money stored in the collecting and storing unit to the transport unit, and the control unit is configured to perform a control such that before the money collecting process is performed, when the amount-of-money data is larger than the limit sum, money stored in the collecting and storing unit is fed out to the transport unit and the fed-out money is transported to another processing unit, so that the amount-of-money data becomes not more than the limit sum.

12. The money handling apparatus according to claim 11, wherein the other processing unit is a dispense unit configured to take out money to an outside of the housing of the money handling apparatus.

13. The money handling apparatus according to claim 11, wherein a plurality of the collecting and storing units are provided, and when money transported by the transport unit is stored into one of the plurality of collecting and storing units, the control unit makes another collecting and storing unit serve as the other processing unit.

14. The money handling apparatus according to claim 11, wherein the other processing unit is a storing and feeding unit provided in the housing of the money handling apparatus, the storing and feeding unit being configured to store and feed money.

15. The money handling apparatus according to claim 14, wherein when the transport of money to the collecting and storing unit becomes possible after the money collecting process has been performed, the control unit performs a control such that money is fed out from the storing and feeding unit, and the transport of the money to the collecting and storing unit is resumed.

* * * * *